US008739592B2

(12) United States Patent
Kapp

(10) Patent No.: US 8,739,592 B2
(45) Date of Patent: Jun. 3, 2014

(54) DEVICE FOR THE PRODUCTION OF MOLDED PARTS

(75) Inventor: Dieter Kapp, Wilnsdorf (DE)

(73) Assignee: Theodor Graebener GmbH & Co. KG, Netphen-Werthenbach (DE)

( * ) Notice: Subject to any disclaimer, the term of this patent is extended or adjusted under 35 U.S.C. 154(b) by 867 days.

(21) Appl. No.: 12/736,867

(22) PCT Filed: Jan. 26, 2010

(86) PCT No.: PCT/EP2010/000425

§ 371 (c)(1),
(2), (4) Date: Nov. 18, 2010

(87) PCT Pub. No.: WO2010/094383

PCT Pub. Date: Aug. 26, 2010

(65) Prior Publication Data

US 2011/0061437 A1 Mar. 17, 2011

(30) Foreign Application Priority Data

Feb. 20, 2009 (EP) ..... 09002392

(51) Int. Cl.
*B21D 22/00* (2006.01)

(52) U.S. Cl.
USPC ..... 72/347; 72/57

(58) Field of Classification Search
USPC ..... 72/345, 346, 347, 352, 360, 379.2, 72/379.6, 407, 453.01, 453.18, 455, 456, 72/463, 467, 57, 60, 63
See application file for complete search history.

(56) References Cited

U.S. PATENT DOCUMENTS

| | | | | |
|---|---|---|---|---|
| 3,545,372 | A * | 12/1970 | Mueller | 72/455 |
| 4,343,174 | A * | 8/1982 | Hahn et al. | 72/349 |
| 4,419,878 | A * | 12/1983 | Fusser | 72/455 |
| 4,696,180 | A * | 9/1987 | Zandel | 72/456 |
| 7,080,536 | B2 | 7/2006 | Kapp | |

FOREIGN PATENT DOCUMENTS

| | | |
|---|---|---|
| DE | 200 19 213 | 3/2001 |
| DE | 199 55 518 | 5/2001 |
| DE | 10 2005 036 429 | 2/2007 |
| EP | 1 075 882 | 2/2001 |
| EP | 1 502 672 | 2/2005 |

OTHER PUBLICATIONS

International Search Report.

* cited by examiner

*Primary Examiner* — Shelley Self
*Assistant Examiner* — Pradeep C Battula
(74) *Attorney, Agent, or Firm* — Collard & Roe, P.C.

(57) ABSTRACT

Disclosed is a device for producing molded articles, comprising two cross members that are interconnected using tie rods. At least one cross member (11, 12) has an annular section accommodating a pressing module. At least one passage (30) is formed between at least two supporting blocks (3) which allow the distance between the cross members (11, 12) to be adjusted.

17 Claims, 6 Drawing Sheets

DEVICE FOR THE PRODUCTION OF MOLDED PARTS

CROSS REFERENCE TO RELATED APPLICATIONS

Figure 1:
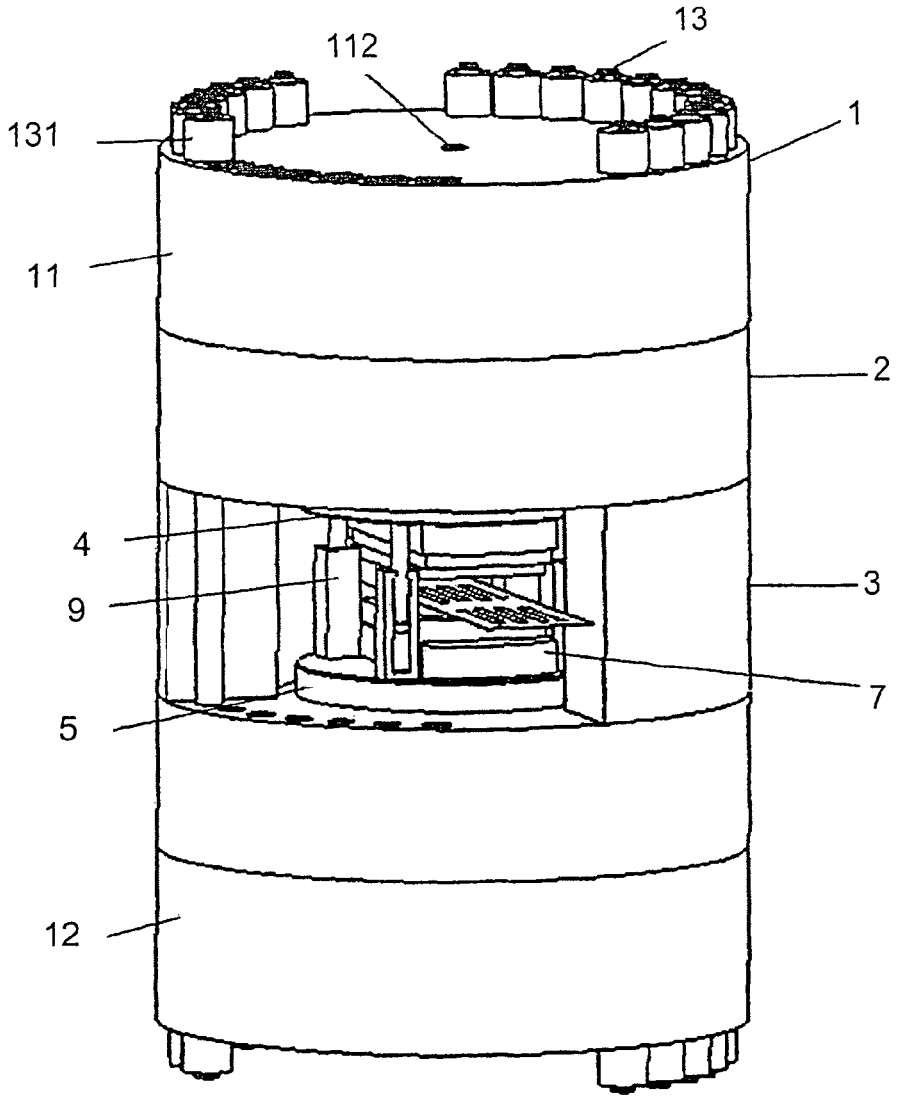

This application is the National Stage of PCT/EP2010/000425 filed on Jan. 26, 2010, which claims priority under 35 U.S.C. §119 of European Application No. 09002392.0 filed on Feb. 20, 2009, the disclosure of which is incorporated by reference. The international application under PCT article 21(2) was not published in English.

The invention relates to a device for the production of molded parts, comprising two cross members that are connected with one another by way of tie rods.

For the production of work pieces by means of a non-cutting forming process, presses are usually used, in which forming tools are inserted, in order to accommodate a work piece blank and then to bring it into the desired shape by means of the corresponding effect of force. Particularly in the sector of forming plate-shaped semi-finished products, such as metal sheets, for example, but also for forming other semi-finished products, such as pipes, for example, the method of high-pressure forming (English: hydroforming) has established itself; this method is characterized by great design flexibility in the shaping and allows very great degrees of forming. In this connection, the semi-finished product is pressed against a molding tool with very high pressure, and the forming is achieved in this way. In this connection, great forces that act in the opposite direction occur, and these have to be absorbed by a stand. The forces that occur transverse to the mold parting are absorbed by the hydroforming tool. This stand generally consists of two yokes that lie opposite one another and are configured to be essentially rectangular, which are held together by way of tie rods.

It is a disadvantage of the aforementioned presses that they are configured to be very space-intensive, because of their method of construction and the required dimensioning due to the forces that occur during the forming process. Furthermore, the previously known presses are inflexible with regard to the use of different tools having different forming depths.

This is where the invention wants to provide a remedy. The present invention is based on the task of creating a device for the production of molded parts, which has a compact structure and allows variable use with little refitting effort. According to the invention, this task is accomplished by means of the characteristics of claim 1.

With the invention, a device for the production of molded parts is created, which has a compact structure and allows variable use with little refitting effort. By means of providing at least two support blocks, the distance between the two cross members, relative to one another, can be adjusted, and therefore variable adaptation of the press to different tools having different forming depths is made possible. Furthermore, a passage is produced between the two support blocks, which passage allows the semi-finished products to be formed to pass through, in other words the work piece to be formed can be introduced into the device at the one side of the passage, and leave the device again on the other side of the passage, after having been formed. By means of providing such a passage, it is also made possible to form sheet metal using the through-cycling method.

In the following, the term "pressing module" is understood to mean any device that is suitable for exerting a pressure force in the direction of the cross member disposed opposite it. The device according to the invention is suitable for the method of internal high-pressure forming (hydroforming) when corresponding forming tools are used, but it is not restricted to this method.

In a further development of the invention, the cross members have a base surface that is configured to be essentially circular. In this way, uniform introduction of the forming forces into the tie rods is guaranteed.

In an embodiment of the invention, the tie rods are configured in cylindrical shape and are provided with a bracing device on at least one end. In this way, simple refitting of the device is made possible. The upper cross member can easily be removed from the tie rods or affixed to them, respectively, and afterwards, the tie rods can be fixed in place on the cross member using the bracing device. For example, the bracing device can be constituted by a threaded section of the tie rods, on which bracing is made possible by way of a nut. Any device for releasable bracing and fixation of a tie rod is suitable. This also includes production of the bias by way of the cylinder(s) that are part of the machine, with mechanical locking of the bracing distance produced by them.

In another embodiment of the invention, at least one ring-shaped section of a cross member is configured as a separate support ring, which is connected with the cross member with shape fit. By means of providing a separate support ring, notch effects are prevented, such as those that occur when a cylindrical recess is provided, between the bottom and the side walls of such a recess. When forces that act horizontally occur, the support ring can expand toward the outside, without any damage occurring to the cross member that is connected with this support ring, with shape fit.

In a further development of the invention, the pressing module comprises at least one hydraulic cylinder. In this way, it is made possible to position the molded part against the tool. In addition, a short-stroke cylinder can be mounted on the cylinder piston. Such cylinders allow defined positioning of the molded part against the tool and ensure that the tool is optimally closed during the forming process.

In an embodiment of the invention, the hydraulic cylinder is constituted by a ring-shaped section in which a piston is guided. In this way, a compact method of construction is made possible, with minimization of components. The cross member, provided with a ring-shaped section, additionally takes on the function of a cylinder housing.

Preferably, the cross member is provided with at least one cylinder bore for supplying fluid to the hydraulic cylinder. The fluid performs two tasks: For one thing, it allows uniform pressure application to the piston guided in the cylinder; for another, it constitutes a pressure cushion between cylinder/cross member and piston, and thus serves for uncoupling of cross member and piston, thereby counteracting bending of the piston.

It is advantageous if at least two press-back cylinders are provided to guide the piston of the hydraulic cylinder. These press-back cylinders serve, for one thing, for displacing the piston of the hydraulic cylinder within the cylinder housing; in particular, the press-back cylinders are used to press the piston back into the starting position. For another thing, the press-back cylinders serve for guiding the piston of the hydraulic cylinder and thus prevent jamming and twisting of the piston. Alternatively or additionally, other guidance systems can also be used.

In an embodiment of the invention, the pressing module has an accommodation for a hydroforming tool. In this way, the device according to the invention can be used for the high-pressure forming method.

In another embodiment of the invention, two support blocks configured essentially in the shape of a half-circle ring are provided, between which a passage that is suitable for allowing a metal sheet to be molded to cycle through is produced. In this way, continuous forming of sheet metal present as a coil is made possible.

In an alternative embodiment of the invention, four support blocks configured essentially in the shape of quarter-circle rings are provided, between which two passages are produced, of which at least one passage is suitable for allowing a metal sheet to be molded to cycle through. By means of the second passage, further processing of a formed part, by means of laser, for example, is made possible. If the width of the second passage is sufficient, the possibility of passing semi-finished products through from both sides is actually created. In this way, the flexibility of the device is further increased.

In another embodiment of the invention, the support blocks are constituted from multiple, preferably plate-like partial segments that are stacked on top of one another. In this way, a step-by-step change in the height of the support blocks is made possible, by adding or removing individual partial segments. Alternatively, the support blocks can also be segmented vertically.

Figure 2:
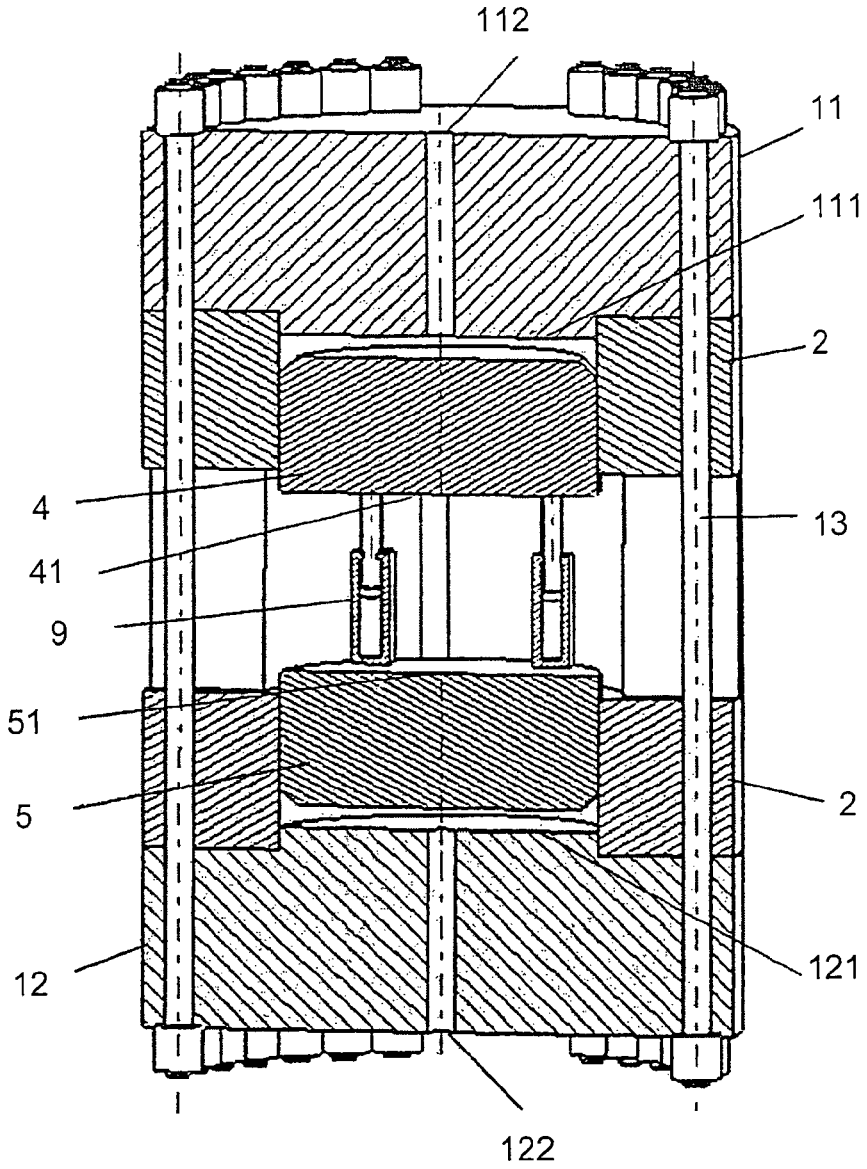
Figure 3:
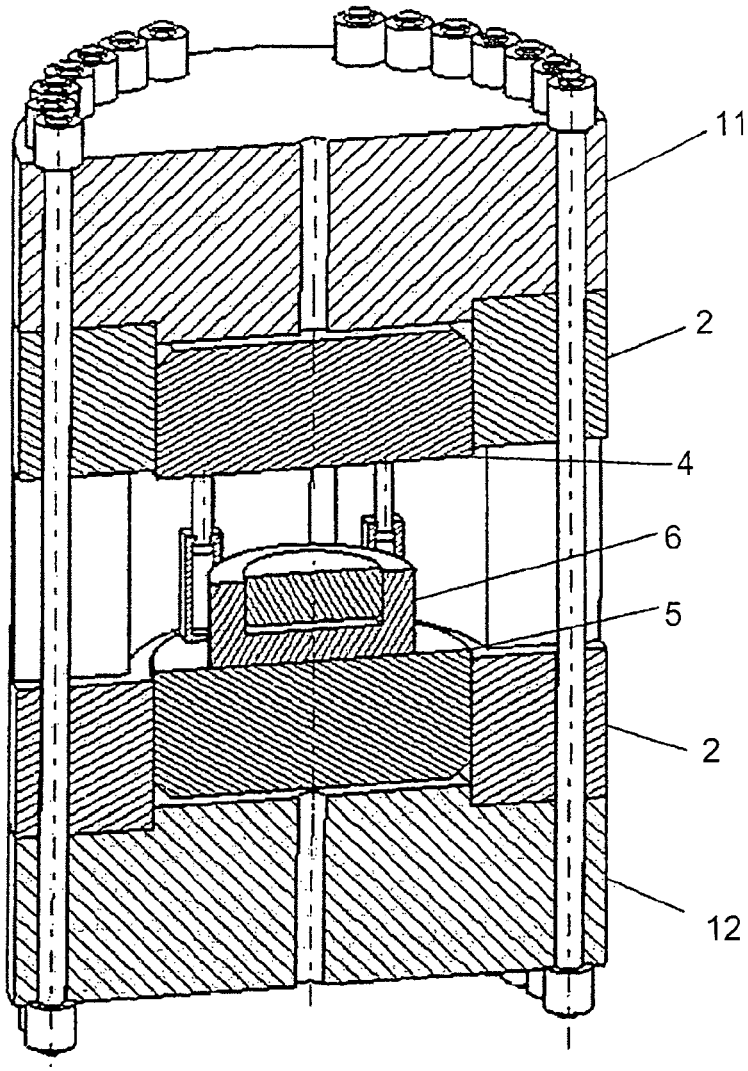
Figure 4:
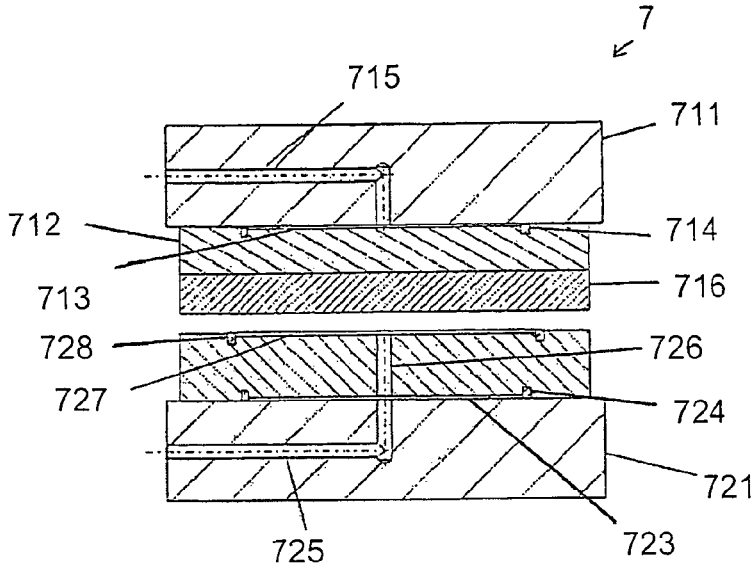
Figure 5:
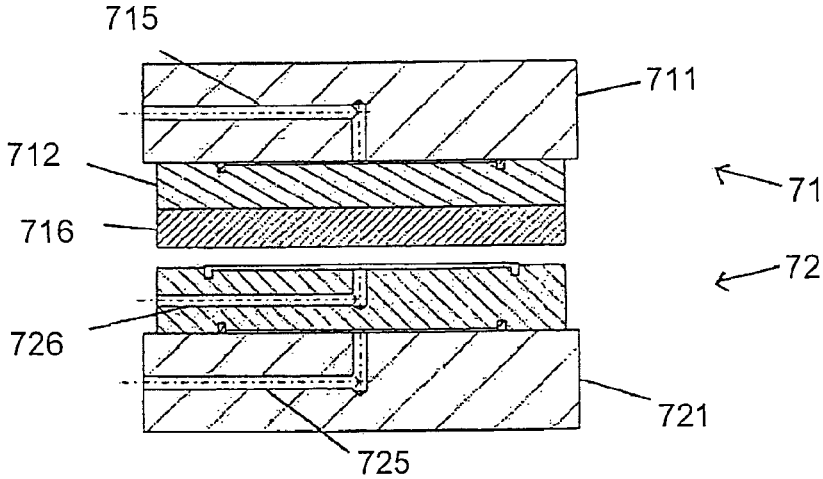
Figure 6:
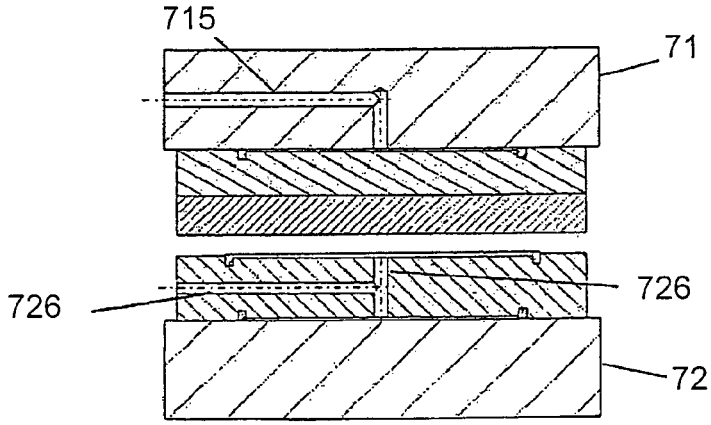
Figure 7:
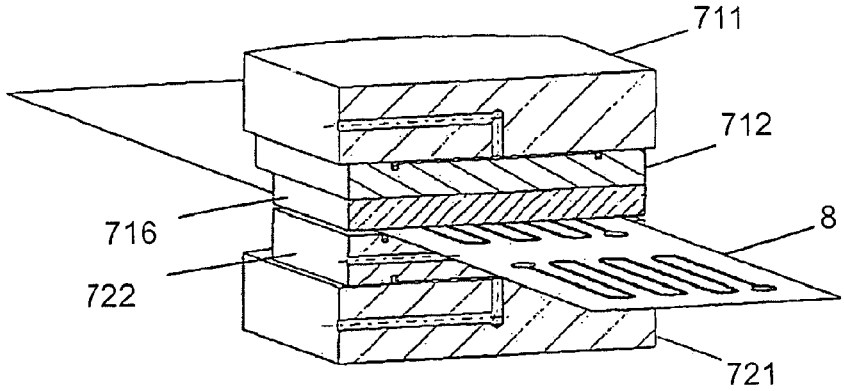
Figure 8:
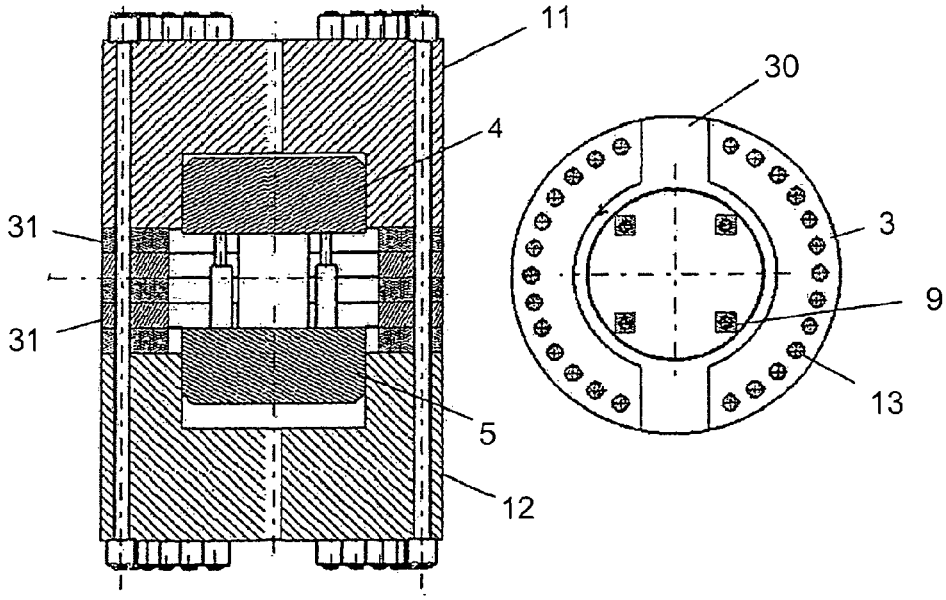
Figure 9:
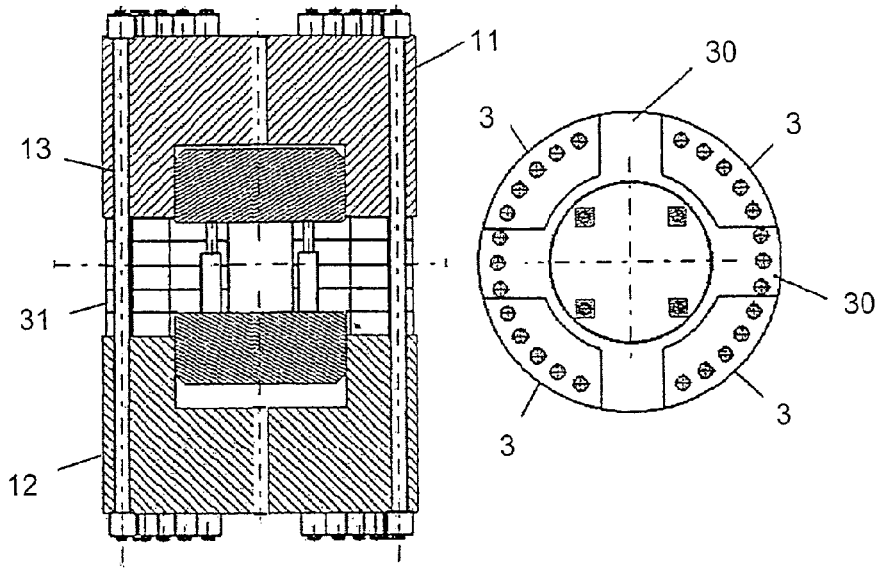
Figure 10:
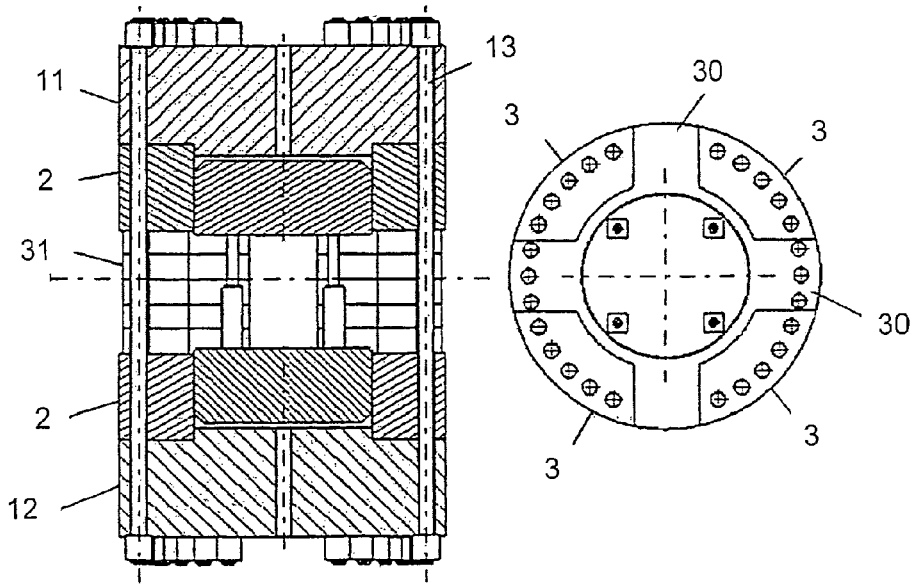

Other further developments and embodiments of the invention are indicated in the remaining dependent claims. An exemplary embodiment of the invention is shown in the drawings and will be explained in detail below. The drawings show:

FIG. 1 the schematic, spatial representation of a device for the production of molded parts;

FIG. 2 the representation of the device from FIG. 1 in section (without tool);

FIG. 3 the representation of the device from FIG. 2 with additionally provided short-stroke cylinder;

FIG. 4 the schematic representation of the hydroforming tool of the device from FIG. 1;

FIG. 5 the schematic representation of a hydroforming tool in another embodiment;

FIG. 6 the schematic representation of a hydroforming tool in a third embodiment;

FIG. 7 the three-dimensional, sectional representation of the tool from FIG. 5, with a formed metal sheet;

FIG. 8 the schematic representation of a device for the production of molded parts, having a passage and multi-part support blocks in the shape of half-circle rings, in section;

FIG. 9 the representation of the device according to FIG. 8 with two passages and multi-part support blocks in the shape of quarter-circle rings, in section, and FIG. 10 the schematic representation of a device according to FIG. 9 with a separate support ring and multi-part support blocks in the shape of quarter-circle rings.

The device selected as an exemplary embodiment, for the production of molded parts, is configured for the method of internal high-pressure forming and comprises a housing 1 that is formed by two cross members 11, 12 configured in the manner of a cylinder and disposed to lie opposite one another, which are connected with one another circumferentially by way of tie rods 13. The tie rods 13 are configured as cylindrical rods that have an outside thread—not shown—at both ends, which threads accommodate nuts 131 for bracing the tie rods 13. Alternatively, the tie rods can also have an oval or polygonal cross-section.

The cross members 11, 12 centrally have a circular recess 111, 121, for shape-fit accommodation of a circumferential support ring 2. The support rings 2 have an outside diameter that is identical with that of the cross members 11, 12, as well as an inside diameter that corresponds to the outside diameter of the recesses 111, 121.

Within the support rings 2, a piston 4, 5 is disposed, in each instance, in such a manner that a hydraulic cylinder is produced with a cross member 11, 12, in each instance, with its related support ring 2. In this connection, cross member 11, 12 and support ring 2 constitute the cylinder housing in which the piston 4, 5 is guided in displaceable manner. A cylinder bore 112, 122 is centrally introduced into the cross members 11, 12, in each instance, which bore serves to supply the hydraulic cylinder formed in this way with hydraulic fluid. For this purpose, the cylinder bores 112, 122 are connected with a hydraulic line—not shown—in each instance.

In an alternative embodiment, also only the lower cross member 12, which is provided with a cylinder bore 121, with the support ring 2 disposed on it, can be configured as a hydraulic cylinder, in interaction with the piston 5, and the upper cross member, which does not have to have a cylinder bore 112, accommodates a pressure cushion, for example a rubber cushion, within the support ring 2, against which cushion the upper piston 4 rests. In this connection, the rubber cushion serves for bending compensation; application of pressure to the upper piston 4, in the direction of the opposite lower piston 5, does not take place.

In the exemplary embodiment, four press-back cylinders 9 are disposed between the pistons 4, 5. The press-back cylinders 9 serve for return movement of the pistons 4, 5 within the support rings 2, directed in the direction of the cross members 11, 12. Furthermore, jamming of the pistons 4, 5 within the support rings 2 can be prevented by way of the press-back cylinders 9.

A spacer plate 711, 721 of a hydroforming tool 7 is attached to the piston 4, 5, in each instance. To optimize the positioning of a work piece to be formed, an additional short-stroke cylinder 6 can be provided on the lower piston 5 (see FIG. 3), on which, in turn, the lower spacer plate 721 is mounted. Of course, placement of an additional short-stroke cylinder on the upper piston 4 is also possible.

The hydroforming tool 7 essentially consists of an upper tool part 71 and a lower tool part 72. The upper tool part 71 comprises an upper spacer plate 711, on which a compensation plate 712 for bending compensation is affixed. The compensation plate 712 has a planar depression 713 on its side that faces the spacer plate 711, which depression is sealed off with regard to the spacer plate 711 by way of a seal 714, and into which depression a hydraulic line 715 disposed within the spacer plate flows. On its underside, which faces away from the spacer plate 711, a tool plate 716, which has the contour to be formed into the work piece 8, is disposed on the compensation plate.

The lower tool part 72 comprises a lower spacer plate 721, on which a compensation plate 722 for bending compensation is affixed. In the exemplary embodiment according to FIG. 4, the lower spacer plate 721 is configured to be identical to the upper spacer plate 711. The compensation plate 722 has a planar depression 723 on its side facing the spacer plate 721, which depression is sealed off with regard to the spacer plate 721 by way of a seal 724, and into which depression a hydraulic line 725 disposed within the spacer plate flows. Centered in the depression 723, a hydraulic line 726 configured to be perpendicular is disposed in the compensation plate 722, which line flows into a second depression 727 of the compensation plate 722 disposed to lie opposite the depression 723 of the compensation plate 722. The second depression 727, which faces the upper tool half 71, is sealed with regard to the work piece 8 that lies on it and is to be processed, by way of a seal 728. Sealing can also take place purely metallically, in other words without a seal 728.

The depressions 713, 723, 727 are merely configured to be very flat and serve for area-wide distribution of the fluid supplied by way of the hydraulic lines 715, 725, 726, thereby producing a pressure cushion. In the forming of a work piece 8 introduced between the upper tool half 71 and the lower tool half 72, the work piece 8 has fluid applied to it, under high pressure, by way of the lines 723, 727, and it is pressed against the contour of the tool plate 716. In this connection, the compensation plate 722 is sealed with regard to the work piece 8, by way of the seal 728. Possible bending of the tool plate 716, brought about by the forming pressure that is applied, can be compensated in that the compensation plate 712 has fluid applied to it, under pressure, by way of the line 715, thereby bringing about bending in or opposite to the pressure-indicated direction (defined adjustability of the pressure bending of the tool plate 716). Compensating counter-bending of the lower compensation plate 722 is also brought about by way of the planar depression 723.

In the exemplary embodiment according to FIG. 6, the hydraulic line 725 is also disposed within the compensation plate. Here, no hydraulic line is required in the lower spacer plate 721.

In the exemplary embodiment according to FIG. 5, the line 726 within the compensation plate is configured in such a manner that it is separated from the hydraulic line 725 disposed within the spacer plate 721, and can be supplied by way of a separate fluid feed. In this way, the compensation plate 722 can have pressure applied to it, by way of the line 725, by means of a fluid, independent of the pressure being applied for forming within the line 726, and thus defined bending for compensation, directed in the direction of the upper tool half 71, can be achieved.

In the exemplary embodiment according to FIG. 1, two support blocks 3 essentially in the shape of half rings are disposed between the support rings 2, which blocks delimit the distance of the two support rings 2 relative to one another by their height. A passage 30 for passing through work pieces 8 to be formed is produced by means of the two support blocks 3 in the shape of half rings (see FIG. 8). In the exemplary embodiment, this passage 30 is suitable for cycling slit strips through. By means of the use of different support blocks 3, it is possible to vary the distance between the support rings 2, thereby making the effective processing height between the pistons 4, 5 adjustable.

In the exemplary embodiment according to FIG. 8, the support rings 2 are formed onto the cross members 11, 12. However, this exemplary embodiment also contains the disadvantage of the notch effect, thereby weakening the cross members 11, 12 on the inside, in the transition to the support rings 2.

In the exemplary embodiment according to FIGS. 8 to 10, the support blocks 3 are constituted from plate-like partial segments 31 that are disposed one on top of the other. By adding or removing individual partial segments 31, an optimal setting of the working height between the pistons 4, 5 can be adjusted.

In the exemplary embodiment according to FIGS. 9 and 10, four support blocks 3 in the shape of quarter-circle rings are provided, which blocks in turn are constituted from multiple partial segments 31 stacked one on top of the other. By means of the placement of four support blocks in the shape of quarter rings, two passages 30 disposed orthogonal to one another are produced, thereby making it possible to cycle through from both sides. The support blocks can alternatively also be configured in such a manner that a broad passage for cycling work pieces 8 through and a narrow passage, whose two openings, which lie opposite one another, can serve for additional processing, for example by means of laser, are produced.

The object of the present invention is not restricted to the high-pressure forming method, and instead, different forming devices can be used between the cross members 11, 12. For example, it is also possible to bring about the required forming pressure by means of hydraulic cylinders constituted by the two cross members 11, 12 with support rings 2 that lie opposite one another, and pistons 4, 5 guided in them, whereby the tool matrices, in each instance, are disposed on the pistons 4, 5.

The invention claimed is:

1. Device for the production of molded parts, comprising first and second cross members, tie rods, a ring-shaped section, first and second support blocks, and a pressing module, wherein said first and second cross members are connected with one another by way of said tie rods, wherein said ring-shaped section accommodates said pressing module, wherein a first passage is disposed between said first support block and said second support block, wherein a distance between said first and second cross members relative to one another can be adjusted via said first support block and via said second support block, wherein the device further comprises a tool plate and a hydroforming tool having a compensator for compensation of process-pressure-induced bending of the tool plate, wherein the compensator comprises a first compensation plate that can be bent, under hydraulic control, in or counter to the process-pressure-induced bending direction of the tool plate, and wherein the first compensation plate has a depression for producing a hydraulic pressure cushion.

2. Device according to claim 1, wherein said first and second cross members have a base surface that is configured to be essentially circular.

3. Device according to claim 1, wherein the tie rods are configured to be cylindrical and are provided with a bracing device on at least one end.

4. Device according to claim 1, said ring-shaped section is configured as a separate support ring connected with the first cross member via shape fit.

5. Device according to claim 1, wherein the pressing module comprises at least one hydraulic cylinder.

6. Device according to claim 5, wherein the hydraulic cylinder is constituted by a ring-shaped section in which a piston is guided.

7. Device according to claim 6, further comprising at least two press-back cylinders guiding the piston of the hydraulic cylinder.

8. Device according to claim 1, wherein the pressing module has an accommodation for a hydroforming tool.

9. Device according to claim 1, wherein at least one of said first cross member and said second cross member is provided with at least one cylinder bore for supplying fluid to a hydraulic cylinder.

10. Device according to claim 1, wherein said first and second support blocks are each configured essentially in the shape of half-circle rings, and wherein said first passage is suitable for cycling through a work piece to be formed.

11. Device according to claim 1, further comprising third support block, fourth support block, and a second passage disposed between said third and fourth support blocks wherein each of said first, second, third, and fourth support blocks are configured essentially in a shape of a quarter-circle ring, and wherein at least one of said first and second passages is suitable for cycling through a work piece to be formed.

12. Device according to claim 1, wherein said first support comprises a plurality of first partial segments stacked one on top of the other, and wherein said second support block comprises a plurality of second partial segments stacked one on top of the other.

13. Device according to claim 1, wherein the first compensation plate is connected, over its area, with a first spacer plate, wherein at least one hydraulic line is introduced in the first spacer plate, and wherein said at least one hydraulic line flows into the depression of the first compensation plate.

14. Device according to claim 1, wherein the compensator comprises first and second spacer plates of the hydraulic tool, the first and second spacer plates lying opposite one another and being configured to be identical to each other.

15. Device for the production of molded parts, comprising first and second cross members, tie rods, a ring-shaped section, first and second support blocks, and a pressing module, wherein said first and second cross members are connected with one another by way of said tie rods, wherein said ring-shaped section accommodates said pressing module, wherein a first passage is disposed between said first support block and said second support block, wherein a distance between said first and second cross members relative to one another can be adjusted via said first support block and via said second support block, wherein the device further comprises a tool plate and a hydroforming tool having a compensator for compensation of process-pressure-induced bending of the tool plate, wherein the compensator comprises a first compensation plate that can be bent, under hydraulic control, in or counter to the process-pressure-induced bending direction of the tool plate, and further comprising a first spacer plate, a second spacer plate, and a second compensation plate, the second compensation plate compensating process-pressure-induced bending of the work piece to be formed, wherein said second compensation plate is attached on said second spacer plate, wherein said second spacer plate lies opposite the first spacer plate and serves for the work piece to lie on, wherein the second compensation plate has a side facing away from the second spacer plate and has a first depression on the side facing away from the second spacer plate, and wherein a first hydraulic line runs within the second compensation plate and flows into the first depression.

16. Device according to claim 15, wherein the second compensation plate has a side facing the second spacer plate and has a second depression on the side facing the second spacer plate, and wherein a second hydraulic line runs within the second compensation plate and flows into the second depression.

17. Device for the production of molded parts, comprising first and second cross members, tie rods, a ring-shaped section, first and second support blocks, and a pressing module, wherein said first and second cross members are connected with one another by way of said tie rods, wherein said ring-shaped section accommodates said pressing module, wherein a first passage is disposed between said first support block and said second support block, wherein a distance between said first and second cross members relative to one another can be adjusted via said first support block and via said second support block, wherein the device further comprises a tool plate and a hydroforming tool having a compensator for compensation of process-pressure-induced bending of the tool plate, wherein the compensator comprises a first compensation plate that can be bent, under hydraulic control, in or counter to the process-pressure-induced bending direction of the tool plate, and further comprising a first spacer plate, a second spacer plate, and a second compensation plate, the second compensation plate compensating process-pressure-induced bending of the work piece to be formed, wherein said second compensation plate is attached on said second spacer plate, wherein said second spacer plate lies opposite the first spacer plate and serves for the work piece to lie on, wherein the second compensation plate has a side facing the second spacer plate and has a depression on the side facing the second spacer plate, and wherein at least one hydraulic line runs within the second spacer plate and flows into the depression.

* * * * *

UNITED STATES PATENT AND TRADEMARK OFFICE

CERTIFICATE OF CORRECTION

PATENT NO. : 8,739,592 B2
APPLICATION NO. : 12/736867
DATED : June 3, 2014
INVENTOR(S) : Kapp It is certified that error appears in the above-identified patent and that said Letters Patent is hereby corrected as shown below:

In the Claims:

Column 6, line 65, (Line 1 of Claim 11) after the word "comprising," please insert: --a--.

Column 6, line 66, (Line 2 of Claim 11) before the word "fourth" please insert: --a--.

Signed and Sealed this
Ninth Day of September, 2014

Michelle K. Lee

Michelle K. Lee
*Deputy Director of the United States Patent and Trademark Office*